US007164878B2

(12) United States Patent
Yamanaka

(10) Patent No.: US 7,164,878 B2
(45) Date of Patent: Jan. 16, 2007

(54) IMAGE FORMING APPARATUS

(75) Inventor: Takashi Yamanaka, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 267 days.

(21) Appl. No.: 10/808,370

(22) Filed: Mar. 25, 2004

(65) Prior Publication Data

US 2004/0190939 A1 Sep. 30, 2004

(30) Foreign Application Priority Data

Mar. 27, 2003 (JP) ..... P2003-087654

(51) Int. Cl.
*G03G 15/16* (2006.01)
*G03G 15/20* (2006.01)

(52) U.S. Cl. ..... 399/122; 399/320; 399/107

(58) Field of Classification Search ..... 399/122, 399/107, 320, 1, 411
See application file for complete search history.

(56) References Cited

FOREIGN PATENT DOCUMENTS

| | | | | |
|---|---|---|---|---|
| JP | 06064279 | A | * | 3/1994 |
| JP | 4-179981 | A | | 6/1996 |
| JP | 11288142 | A | * | 10/1999 |
| JP | 2001100576 | A | * | 4/2001 |
| JP | 2001206562 | A | * | 7/2001 |
| JP | 2001-331077 | A | | 11/2001 |
| JP | 2003228267 | A | * | 8/2003 |

* cited by examiner

*Primary Examiner*—David M. Gray
*Assistant Examiner*—Ryan D. Walsh
(74) *Attorney, Agent, or Firm*—Birch, Stewart, Kolasch & Birch, LLP

(57) ABSTRACT

A fixing device for fixing an image formed on a sheet member is disposed on a transportation path for transporting the sheet member thereon. The fixing device can be attached to or detached from the main body of an image forming apparatus, and a guide member is provided in the image forming apparatus for guiding the fixing device when it is attached to or detached from the main body of the image forming apparatus. The guide member includes an inclined surface on which the fixing device is placed to be guided upward for attachment. If the fixing device is unlocked from the main body of the image forming apparatus at the time of maintenance or the like, the fixing device is moved outwardly along the inclined surface due to its own weight.

12 Claims, 9 Drawing Sheets

IMAGE FORMING APPARATUS

CROSS REFERENCE

This Nonprovisional application claims priority under 35 U.S.C. § 119(a) on Patent Application No. 2003-087654 filed in Japan on Mar. 27, 2003, the entire contents of which are hereby incorporated by reference.

BACKGROUND OF THE INVENTION

The present invention relates to an image forming apparatus such as a printer, a facsimile or a copying machine.

In an image forming apparatus such as a copying machine or a printer, a sheet member (i.e., a sheet of paper) is supplied to an image forming unit from a sheet supplying tray disposed at a lower portion inside of the apparatus via a transportation path. The sheet supplying tray is adapted to previously contain therein the sheet member for use in image formation. In the sheet supplying tray are normally contained the standard-sized sheet members frequently used, on which an image is easily formed and which is favorably transported.

After the image formation in the image forming unit, the sheet member is discharged outside of the image forming apparatus. In recent years, the complexity of the image forming apparatus has increased and it is desirable that the image forming apparatus should have the functions of a copying machine, a printer, a facsimile and the like in combination, and that the sheet members to be discharged should be classified according to the image forming function, thereby obtaining an image forming system easy to be used. In order to achieve such an image forming system, for example, there has been proposed an image forming apparatus configured such that discharge ports, through which the sheet member in the image forming unit is discharged outside of the image forming apparatus via the transportation path, are disposed on both sides of the apparatus body, thereby facilitating the classification of the sheet members.

Furthermore, the image forming apparatus has been made to cope with space saving by reducing the size of the image forming apparatus or an area occupied for installation. Therefore, the transportation path in the image forming unit in the image forming apparatus is changed from a lateral orientation to a longitudinal orientation (i.e., a vertical direction). Thus, the number of image forming apparatuses having the transportation path of the longitudinal orientation has become increased in recent years.

In this manner, in the case where the transportation path in the image forming unit is oriented longitudinally, there can be configured a short transportation path for transporting the sheet member to the image forming unit from a sheet supplying device disposed at the lower portion in the image forming apparatus. Moreover, there is an advantage of efficient arrangement of the sheet supplying device, a sheet discharging tray unit for classifying the sheet members and stacking them thereon, a post-processing device and the like. To the contrary, since the transportation path is formed near a side surface, there is an inconvenience that an access must be made to the image forming apparatus not in front of the image forming apparatus but from the side surface thereof in the case where the sheet member is jammed on the transportation path.

Moreover, in the case where the transportation path in the image forming unit is oriented longitudinally, fixing means for fixing a developer onto the sheet member with the application of heat and pressure is disposed in the proximity of developing means for developing an electrostatic latent image formed on an image carrier or developer containing means for containing therein the developer (which is generally a toner) to be supplied to the developing means. Therefore, there is likely to cause a trouble that the developer having a melting property due to heat is melted and solidified.

Additionally, in the case where the transportation path in the image forming unit is oriented longitudinally, instability is caused since it is not determined as to whether the sheet member is tilted toward an obverse (i.e., toward the side of an image) or a reverse when the sheet member is transported from a transfer point of an image to be developed with the developer from an image carrier while a not-fixed developer image is carried thereon. As a consequence, the sheet member is unstably transported between a pair of fixing rollers in the fixing means. In addition, there is liable to arise a problem that the not-fixed developer image on the sheet member may be brought into contact with guide means or the like in the state of disorder during the transportation from the transfer point to the fixing means.

In order to solve the above-described problems, the longitudinally oriented transportation path is not a vertical transportation path, but there has been proposed a configuration in which a transportation path is slightly tilted in a direction in which the fixing means is separated from the developing means (that is, in a direction at the reverse of the sheet member, i.e., in a direction opposite to an image forming surface). With this configuration, since the transportation path is tilted, the sheet member passes the fixing means in the state in which the image forming surface is oriented upward.

In comparison with an image forming apparatus having the longitudinally oriented transportation path, which is disposed vertically, there arises a problem that it is difficult to release a cabinet disposed at a side surface and attach or detach a fixing device to or from the main body of the image forming apparatus at the time of maintenance or the like in an image forming apparatus having the above-described slantwise tilted transportation path.

Furthermore, in the case where the fixing device is heated since the image forming apparatus is in an energized state immediately before the maintenance or the like, the fixing device may be detached from the main body of the image forming apparatus when the fixing device stays at a high temperature. Consequently, for example, there has been proposed a configuration in which an abnormal increase in temperature at a grip can be prevented by disposing the grip, which is used in attaching or detaching the fixing device to or from the main body of the image forming apparatus, on a side opposite to heating means (see, for example, page 3, right lower column, lines 7 to 15 and FIGS. 1 and 2 in the specification of JP-A No. 4-179981).

However, as an image forming speed in the image forming apparatus is increased, the temperature at the pair of fixing rollers at the fixing device is liable to be decreased by the sheet member being transported. As a consequence, in the fixing device provided with the heating means only at a roller member of either one of the pair of fixing rollers, the temperature at the other roller member which is not provided with any heating means is extremely decreased, thereby causing fixing deficiency, so as to frequently interrupt an image forming operation.

In view of this, in the fixing device in the image forming apparatus in which the image forming speed is increased, it is general that both of the roller members constituting the pair of fixing rollers are provided with the heating means. In this case, since the temperature at the fixing device as a whole becomes considerably high, a fixing unit must be more carefully handled at the time of the maintenance or the like.

Although the outer wall of the fixing device is normally formed of a heat insulating member in order to keep the temperature to such an extent that there arises no problem even if a hand accidentally touches the outer wall of the fixing device, there is a danger of a burn if the fixing device may be strongly grasped. In particular, in the case where a serviceman or the like takes the fixing device out of the main body at the time of the maintenance, he or she performs the maintenance work after confirmation of the operation of the image forming apparatus. The fixing device is heated up to such a temperature as to fix an image formed on the sheet member immediately before the fixing device is taken out of the apparatus body. As a result, when the serviceman or the like takes the fixing device out of the main body, he or she must be sufficiently cautious.

However, in the case where the serviceman or the like awaits satisfactory heat dissipation from the fixing device while the fixing device remains disposed in the apparatus body until the temperature at the fixing device is decreased down to such a level that it is stable even if the fixing device can be firmly grasped by a hand, a long period of time is required since the fixing device is disposed inside of the apparatus body. Furthermore, operating efficiency is reduced, thereby raising a problem that a service time becomes prolonged in total.

SUMMARY OF THE INVENTION

In view of the above-described problems observed in the prior art, a desirable feature of the present invention is to provide an image forming apparatus, in which heat can be irradiated in a short time in a fixing device at the time of maintenance or the like.

Furthermore, another feature of the present invention may include providing an image forming apparatus, in which a fixing device is moved outside by its own weight by a simple operation, to thus irradiate heat in a short time owing to outside air at the time of the maintenance or the like.

An image forming apparatus according to an embodiment of the present invention comprises: a fixing device having roller members for fixing an image on a sheet member and being disposed on a transportation path, on which the sheet member is transported; an attaching/detaching device for freely attaching or detaching the fixing device to or from the main body of the image forming apparatus; and a guide member provided in the main body of the image forming apparatus, for guiding the fixing device in a slidable manner; wherein the guide member includes an inclined slope, on which the fixing device is placed to be guided slantwise upward, when the fixing device is attached to the image forming apparatus by the attaching/detaching device.

With this configuration, the guide member includes the slope inclined upward in a direction in which the fixing device is inserted. Consequently, the fixing device can slide by utilizing the slope when the fixing device is detached from the apparatus body. As a result, the fixing device can be exposed to the outside with high workability, and further, heat can be efficiently irradiated in the outside air. In contrast, the fixing device can be pushed in by utilizing the slope when the fixing device is attached to the main body of the image forming apparatus. Thus, the fixing device can be attached to or detached from the main body of the image forming apparatus with high workability.

The image is formed on the sheet member on the transportation path, and further, the guide member guides the fixing device in a direction substantially perpendicular to the transportation path. Furthermore, the inclination angle of the slope in the guide member is set at such an angle that the fixing device can slide by its own weight when the fixing device is withdrawn out of the main body of the image forming apparatus. With this configuration, since the inclination angle of the slope of the guide member is set at such an angle that the fixing device can slide down due to its own weight, the fixing device can be taken out without firmly grasping the fixing device by a hand.

DETAILED DESCRIPTION OF THE INVENTION

An image forming apparatus in a preferred embodiment according to the present invention will be described below in reference to the accompanying drawings.

Figure 1:
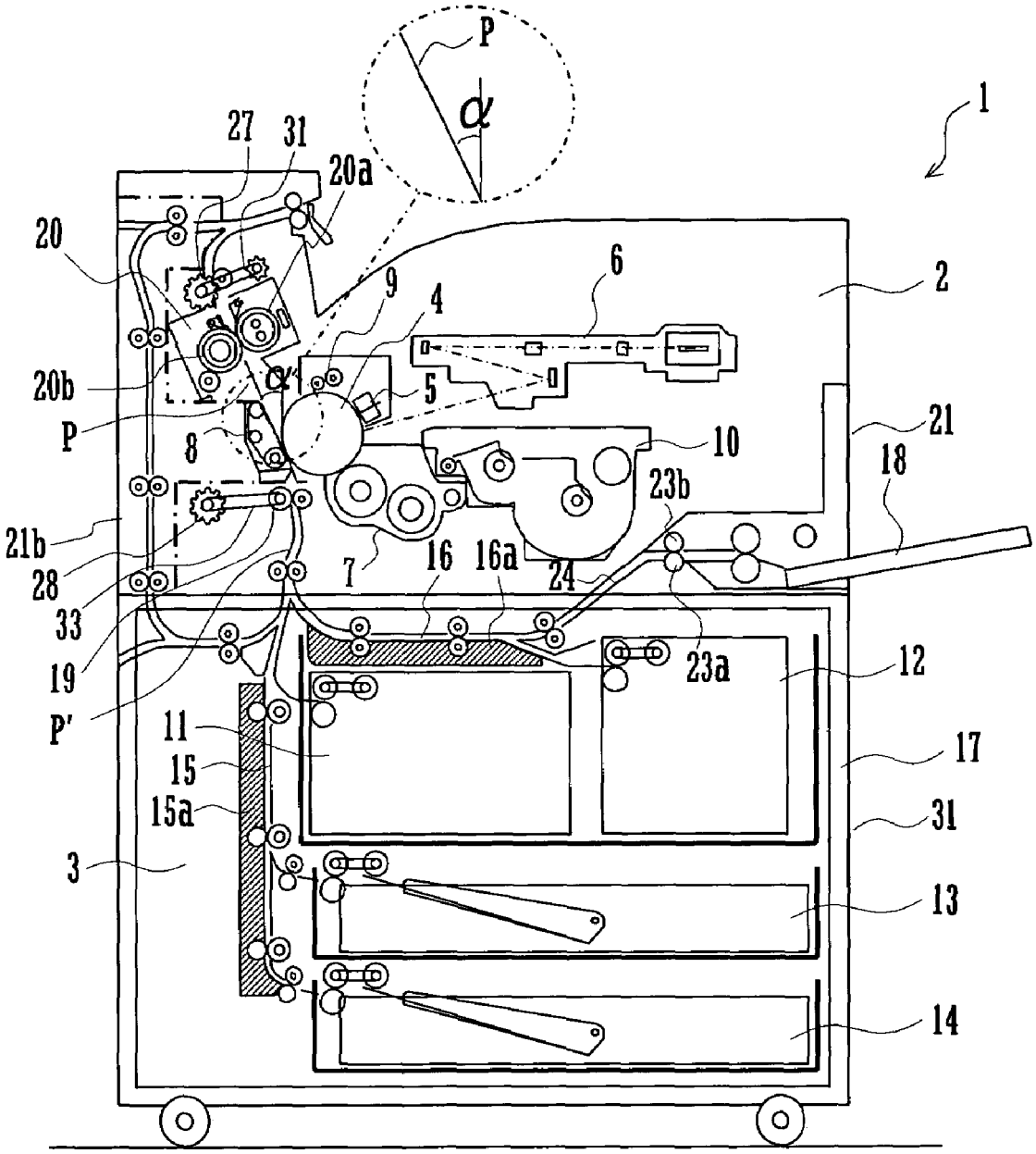
FIG. 1 is a view showing the configuration of an image forming apparatus in a preferred embodiment according to the present invention.

FIG. 1 is a view showing the configuration of an image forming apparatus 1.

The image forming apparatus 1 is provided with a printer unit (i.e., an image forming unit) 2 and a sheet supplying unit 3 disposed under the printer unit 2. At substantially the center of the printer unit 2 is arranged an electrophotographic processing unit including mainly a photosensitive drum 4. Specifically, around the photosensitive drum 4 are arranged a charging unit 5, an optical scanning unit 6, a developing unit 7, a transferring unit 8 and a cleaning unit 9.

Downstream of the photosensitive drum 4 is disposed a fixing unit (corresponding to a fixing device according to the present invention) 20 for fixing a transferred image onto a sheet (i.e., a sheet member) with the application of heat under pressure. The photosensitive drum 4 and the fixing unit 20 are connected to each other via a transportation path P inclined at a predetermined angle $\alpha$ (=25°) in a vertical direction in such a manner that the sheet is transported while a non-fixed image formed on the sheet faces upward. The transportation path P is connected to a vertical path P' formed by allowing a first transportation path 15 and a second transportation path 16, described later, to merge with each other to the photosensitive drum 4.

The charging unit 5 is adapted to uniformly charge the surface of the photosensitive drum 4. The optical scanning unit 6 is adapted to scan an optical image on the uniformly charged photosensitive drum 4, so as to write an electrostatic latent image on the photosensitive drum 4. The developing unit 7 is adapted to develop the electrostatic latent image written by the optical scanning unit 6 with a developer. The transferring unit 8 is adapted to transfer an image, which is recorded and reproduced on the photosensitive drum 4, onto a recording medium.

The cleaning unit 9 is adapted to remove the developer remaining on the photosensitive drum 4, so as to record a new image on the photosensitive drum 4. The remaining developer removed by the cleaning unit 9 is recovered to a developer supplying unit 10 in the developing unit 7, to be thus recycled. Incidentally, the image forming apparatus 1 according to the present invention is not limited to a type including a process for recycling the remaining developer, but it may include an image forming apparatus, in which a developer is recovered and discarded.

Subsequently, explanation will be made on the sheet supplying unit 3.

The sheet supplying unit 3 includes a plurality of sheet supplying trays (i.e., recording medium supplying units) 11, 12, 13 and 14. Since the sheet supplying unit 3 includes these sheet supplying trays 11 to 14, the sheet supplying unit 3 can classify and contain various kinds of sheets serving as the recording mediums, for example, per size.

The image forming apparatus 1 selects one of the sheet supplying trays 11 to 14, and further, separates the sheets one by one from the selected sheet supplying tray, and then, supplies them between the photosensitive drum 4 and the transferring unit 8. Thereafter, the transferring unit 8 transfers, to the supplied sheet, the recorded and reproduced image onto the photosensitive drum 4.

Here, more specific explanation will be made on the sheet supplying trays 11 to 14.

The sheet supplying tray (i.e., a first recording medium supplying unit) 11 and the sheet supplying tray (i.e., a second recording medium supplying unit) 12 are arranged in parallel to each other. The sheet supplying tray 13 is arranged under the sheet supplying tray 11 and the sheet supplying tray 12, and further, the sheet supplying tray 14 is arranged under the sheet supplying tray 13.

The sheet supplying trays 13 and 14 have substantially the same capacity. Each of the sheet supplying trays 11 and 12 has a capacity greater than that of the sheet supplying tray 13 or 14.

The sheet supplying unit 3 includes the first transportation path 15 and the second transportation path 16 in order to transport the sheets contained in the sheet supplying trays 11 to 14 toward the printer unit 2. Incidentally, the first transportation path 15 is adapted to transport the sheets contained in the sheet supplying trays 11, 13 and 14 toward the printer unit 2; in contrast, the second transportation path 16 is adapted to transport the sheets contained in the sheet supplying tray 12 toward the printer unit 2.

Moreover, the first transportation path 15 extends in a vertical direction perpendicular to the base of the sheet supplying unit 3. In contrast, the second transportation path 16 extends in a horizontal direction parallel to the base of the sheet supplying unit 3. Both of the paths 15 and 16 merge with each other into the vertical path P' in the printer unit 2. Consequently, the sheet supplying trays 11 to 14, the first transportation path 15 and the second transportation path 16 are efficiently arranged inside of the sheet supplying unit 3, thereby saving the space of the sheet supplying unit 3. In the case where the sheets are stacked in each of the sheet supplying trays 11 to 14, a target one of the sheet supplying trays 11 to 14 is withdrawn out forward in the main body of the image forming apparatus 1, and then, sheets are replenished.

If the sheet is jammed on the first transportation path 15, a guide 15*a* (indicated by a slash line in FIG. 1) facilitating the first transportation path 15 is pivoted away from opposing rollers along path 15 of a user by using the back side of the sheet supplying unit 3 as a fulcrum. In this manner, the sheet jammed on the first transportation path 15 can be removed. Incidentally, the jammed sheet is removed by utilizing a work space previously defined between the first transportation path 15 and the frame 17.

In contrast, if the sheet is jammed on the second transportation path 16, a guide 16*a* (indicated by a slash line in FIG. 1) facilitating the second transportation path 16 is pivoted away from opposing rollers along path 16 by using the back side of the sheet supplying unit 3 as a fulcrum. In this manner, the sheet jammed on the second transportation path 16 can be removed. Incidentally, the removing work (i.e., recovering work) is carried out by withdrawing the sheet supplying trays 11 and 12 arranged in parallel to each other forward of the user so as to secure the work space under the second transportation path 16.

Although the present preferred embodiment is configured such that the sheet supplying trays 11 and 12 can be withdrawn out at the same time, the present invention is not always limited to the above-described configuration, but each of the sheet supplying trays may be withdrawn independently of each other. In such a case, the work space for removing the sheet jammed on the second transportation path 16 may be secured under the second transportation path 16 by withdrawing the sheet supplying tray 11 forward.

Downstream of the second transportation path 16 is disposed a manually sheet supplying unit (i.e., a third recording medium supplying unit) 18, in which sheets are set in a relatively small quantity. Special sheets are possibly set in the manually sheet supplying unit 18. The sheets can be readily replaced or set in the manually sheet supplying unit 18. Moreover, another sheet supplying unit (i.e., a fourth recording medium supplying unit) may be connected onto a right side in the sheet supplying unit 3, although not shown.

A registration roller member 19 for controlling the corresponding position of a sheet recording medium with respect to the image formed on the photosensitive drum 4 is located upstream in a transportation direction of the photosensitive drum 4 in the printer unit 2. The registration roller member 19 is adapted to temporarily stop the sheet being supplied to the printer unit 2, and then, to bend the leading edge portion of the sheet. Consequently, it is possible to correct the inclination of the sheet, which may be inclined during the transportation to the registration roller member 19, and the sheet is started at a timing of an image to be formed on the photosensitive drum 4 in response to a signal output from a control unit, not shown. Thus, the image is transferred at a proper position on the sheet. As a consequence, a strong abutting force (i.e., a strong holding force) is applied to the registration roller member 19, thereby preventing the sheet from getting into the registration roller member 19 during bending of the sheet when the inclination of the sheet is corrected.

The fixing unit 20 is adapted to fix the image transferred onto the sheet with the application of the heat under the pressure. The fixing unit 20 includes a fixing roller 20*a* containing therein a heater h1 such as a heater lamp, a temperature detector for detecting the temperature at the surface of the fixing roller 20*a*, a pressurizing roller 20*b* for transporting the sheet while pressing the sheet against the fixing roller 20*a*, and an outside heating roller 20*c*, which is brought into contact with the pressurizing roller 20*b* and contains therein a heater lamp h2 for heating the pressurizing roller 20*b*.

In this manner, since the two rollers 20*a* and 20*b* are heated in the fixing unit 20, the two rollers 20*a* and 20*b* are controlled by the control unit, not shown, in such a manner that predetermined surface temperatures are kept in response to a signal output from the temperature detector for detecting the temperature at the surface of each of the rollers. A fixing temperature can be maintained at a constant value even when numerous sheets are sequentially printed at a high speed.

Figure 3:
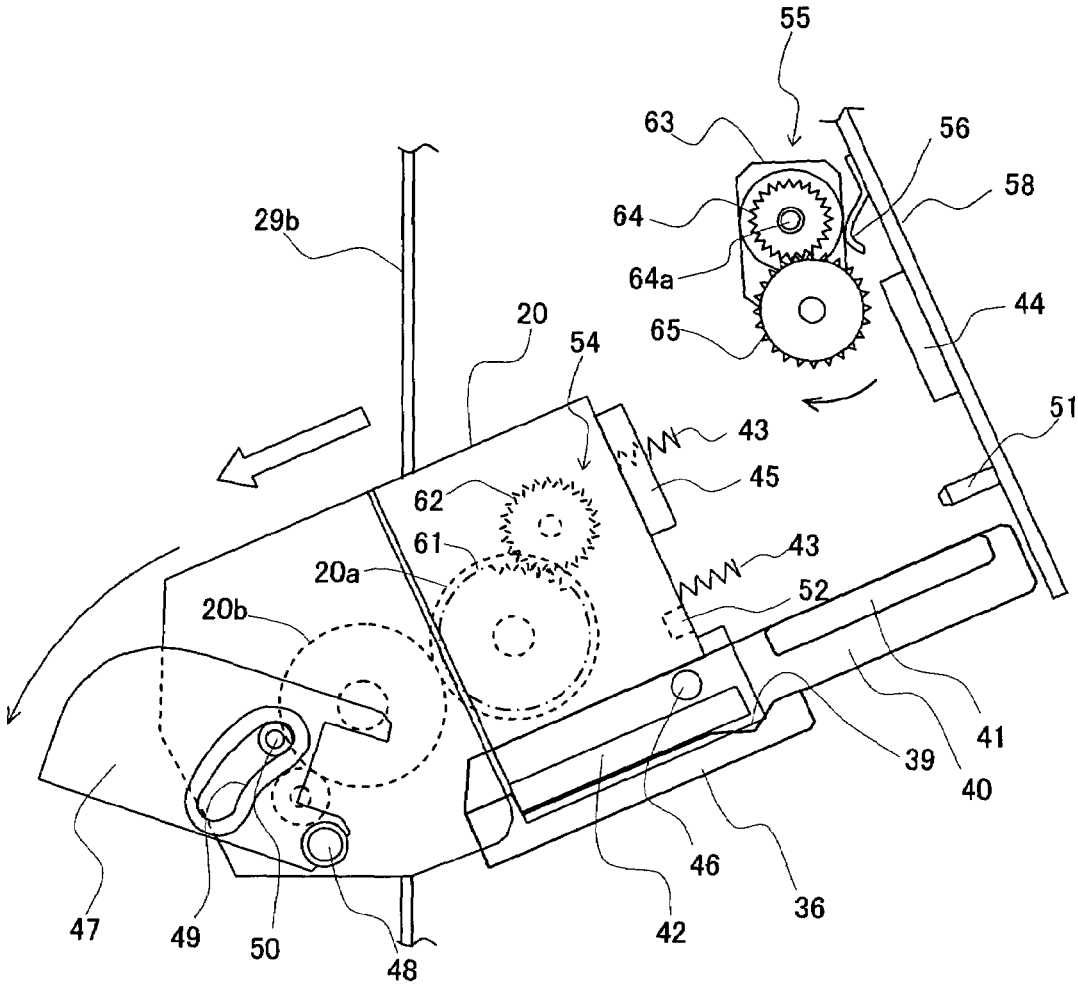
FIG. 3 is a partial view showing a state in which the fixing device is detached from the main body of the image forming apparatus.
Figure 9:
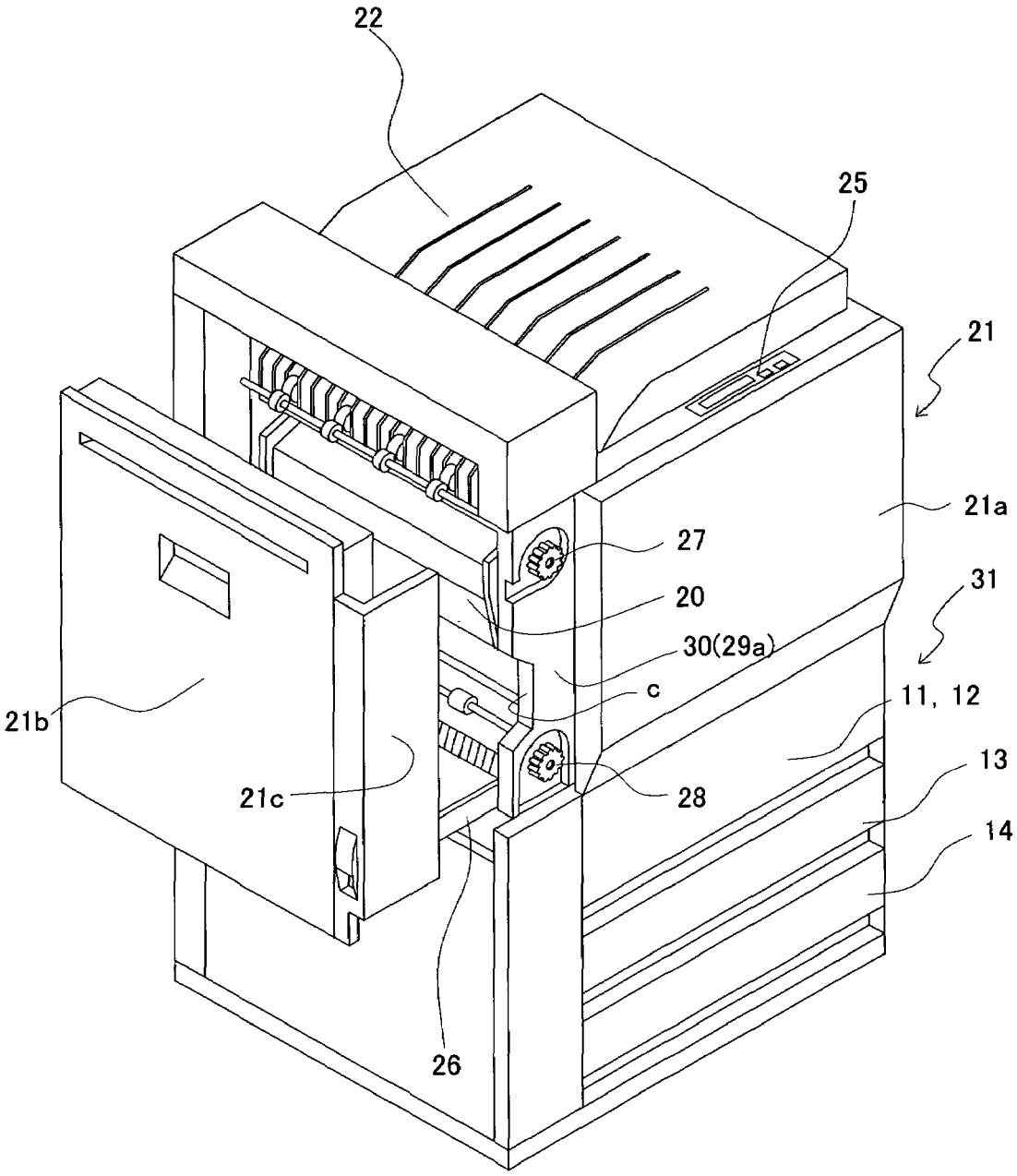
FIG. 9 is a perspective view showing a state in which a cabinet on the side of the image forming apparatus is opened.

Since heat resistance is important for a cover member covering the outside of the fixing unit 20, the cover member is made of a resin material having a heat insulating property such as PET containing glass, in which the cover member becomes considerably high in temperature. Therefore, when the fixing unit 20 is detached from the apparatus body at the time of the maintenance or the like, as described later, a side cabinet 21*b* is withdrawn, as shown in FIG. 9, and further, the fixing unit 20 can be introduced outside owing to its own weight by releasing a locked state without any manual touch, as shown in FIG. 3. In the state, the fixing unit 20 can be naturally and speedily cooled by efficient heat irradiation due to the outside air.

Figure 8:
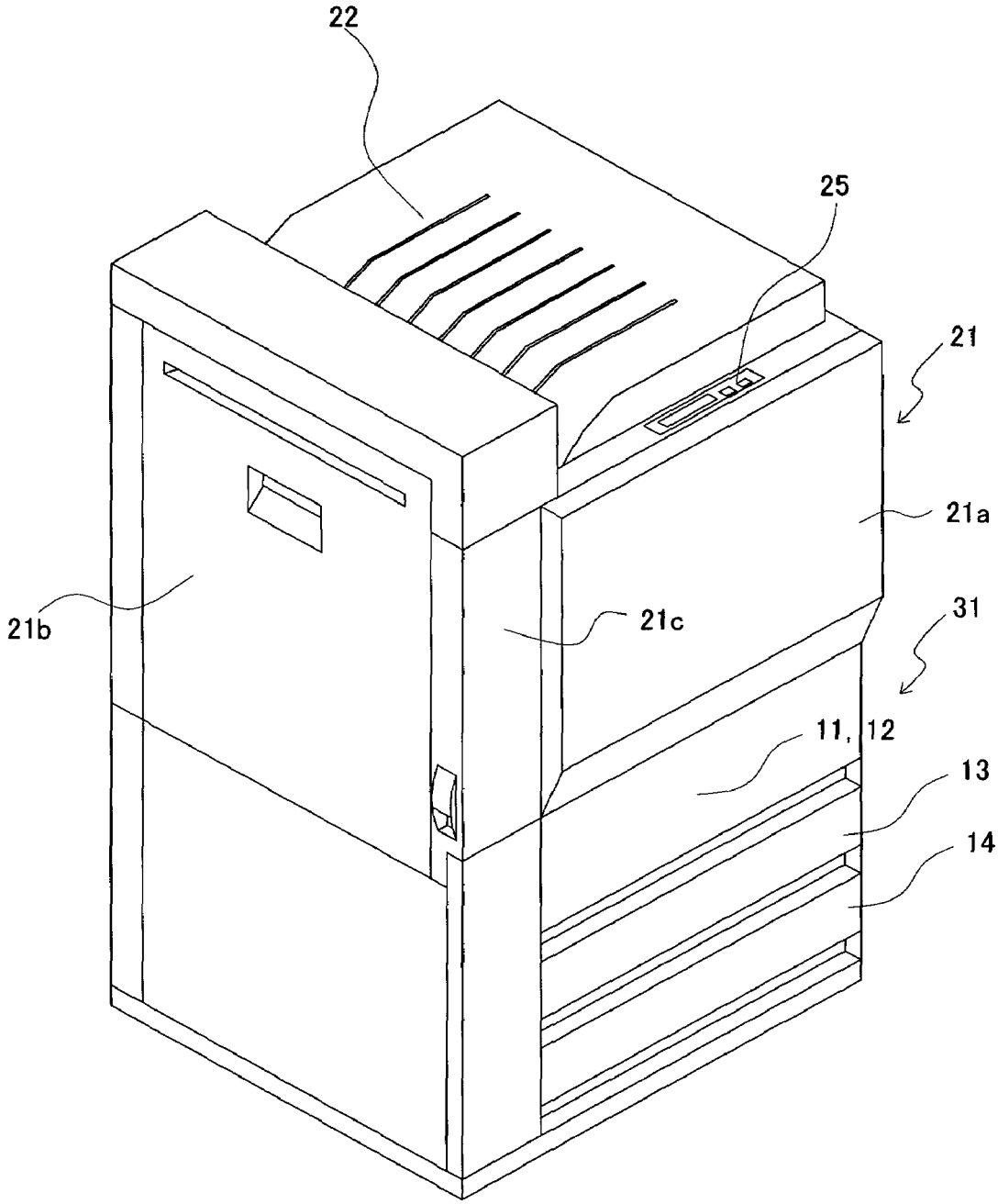
FIG. 8 is a perspective view showing the image forming apparatus.

The cabinet in the image forming apparatus 1 is constituted of a cabinet 21 in the printer unit (i.e., the image forming unit) 2 and another cabinet 31 in the sheet supplying unit 3 located under the printer unit 2. As shown in FIG. 8, at the upper surface of the cabinet 21 in the printer unit 2 is disposed a sheet discharging tray 22. At the front portion of the sheet discharging tray 22 is disposed an operating unit 25 for operating the operation of the image forming apparatus 1.

The side cabinet 21*b* adjacent to a front cabinet 21*a* in the cabinet 21 in the above-described printer unit (the image forming unit) 2 is integrated with a lengthwise pair of rail members 26, which are guided in substantially a horizontal direction by guide members, not shown, disposed in the frame of the apparatus body, as shown in FIG. 9, and further, is configured such that it can be withdrawn (i.e., released) leftward, as shown in FIG. 9.

Incidentally, a portion released together with the side cabinet 21*b* is surrounded by alternate long and short dashed lines in FIG. 1. Alternatively, the lower portion of the side cabinet 21*b* may be turnably pivoted on the frame of the apparatus body and pivoted to open (not illustrated).

Two knobs 27 and 28 are provided at a front frame 29*a* in the apparatus body such that they are exposed to the front of the apparatus body toward a direction perpendicular to the withdrawing direction in which the side cabinet 21*b* is withdrawn from the apparatus body while they are concealed by a front flange 21*c* of the side cabinet 21*b* in the state in which the side cabinet 21*b* is closed.

The two knobs 27 and 28 are arranged separately from each other upstream and downstream of the vertical transportation path in the image forming apparatus 1. At the intermediate portion of the front frame member 29*a* for supporting the two knobs 27 and 28 thereon, there is formed a cutout c, which is largely cut out, together with a cover member 30 covering the outside thereof, thereby achieving a structure in which a hand can be readily put into the image forming apparatus 1 at the time of the jamming processing (i.e., the recovering operation) or the like.

Although the illustration will be omitted, the upper knob 27 is connected to a fixing roller driving pulley in association therewith via an endless belt. The turning operation of the knob 27 enables the fixing roller 20*a* to be turned both forward and reversely. In contrast, the lower knob 28 is connected to a registration roller driving pulley in association therewith via an endless belt. The turning operation of the knob 28 enables the registration roller member 19 to be turned both forward and reversely.

In this manner, since the two knobs 27 and 28 are disposed, the knobs 27 and 28 are exposed forward of the apparatus body when the side cabinet 21*b* is withdrawn from the image forming apparatus 1 at the time of the jamming processing (i.e., the recovering operation) or the like. Consequently, an operator can readily operate from in front of the machine the two knobs 27 and 28, and further, can clearly see both of the knobs 27 and 28 even in the case where the side cabinet 21*b* is withdrawn from a side position, thereby achieving excellent operability.

A lengthwise pair of guide rails (i.e., guide means) 36 for guiding the fixing unit 20 are secured to the front frame 29*a* and a rear frame 29*b* in the apparatus body, as shown in FIGS. 2, 3, 4 and 7. An access to the fixing unit 20 can be achieved in the state in which the side cabinet 21*b* is withdrawn from the image forming apparatus 1, as shown in FIG. 9. At the guide rail 36 is formed a slope 37, which is inclined slightly upward in the direction in which the fixing unit 20 is inserted, as indicated by an arrow A, and is securely disposed in a direction substantially perpendicular to the transportation path P shown in FIG. 1. An inclination angle θ of the slope 37 is set to such an extent that the fixing unit 20 can slide outward by its own weight. Incidentally, although reference numeral 29*b* designates a portion obtained by vertically bending the rear frame at the end in FIGS. 2, 3, 4 and 7, it actually denotes a frame positioned to the rear of the apparatus body. The front frame 29*a* is located forward of the rear frame 29*b* on the sheet, and the front surface thereof is covered with the cover member 30, as shown in FIG. 9.

Since mechanical strength and slidability are required for the guide rail 36, it is preferable that the guide rail 36 should be made of POM (i.e., a polyacetal resin) having self lubricity or the like, and further, should be made of an inexpensive material such as ABS. Although the inclination angle θ of the guide rail 36 is set to, for example, substantially 25° with respect to the horizontal direction in the present preferred embodiment, it is not limited to this, but it may be set to a proper value according to the type of apparatus. Here, if the inclination angle θ is too small, the fixing unit 20 hardly slides; in contrast, if it is too large, the size (i.e., the width) of the image forming apparatus becomes large.

Figure 4:
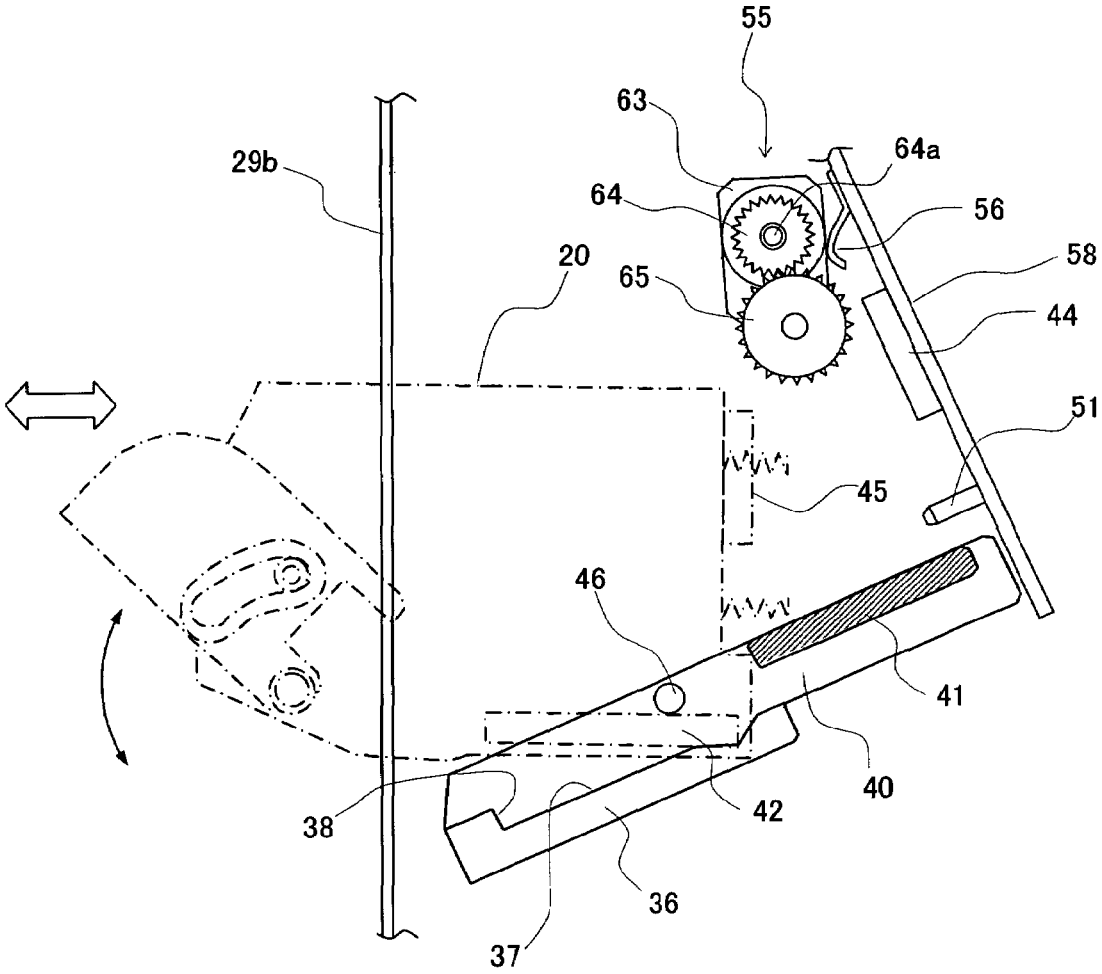
FIG. 4 is a partial view showing a state in which the fixing device is held in a horizontal state.

At the terminal end of the slope 37 of the guide rail 36, there is provided a stopper 38 for stably stopping the fixing unit 20 at the terminal position without any falling when the fixing unit 20 placed on the slope 37 slides downward by its own weight. At the fore portion of the slope 37, there is formed a recess 39 for temporarily engaging and holding the fixing unit 20 in the horizontal state, as shown in FIG. 4, in order to facilitate the attaching/detaching operation when the fixing unit 20 is attached or detached.

Figure 5:
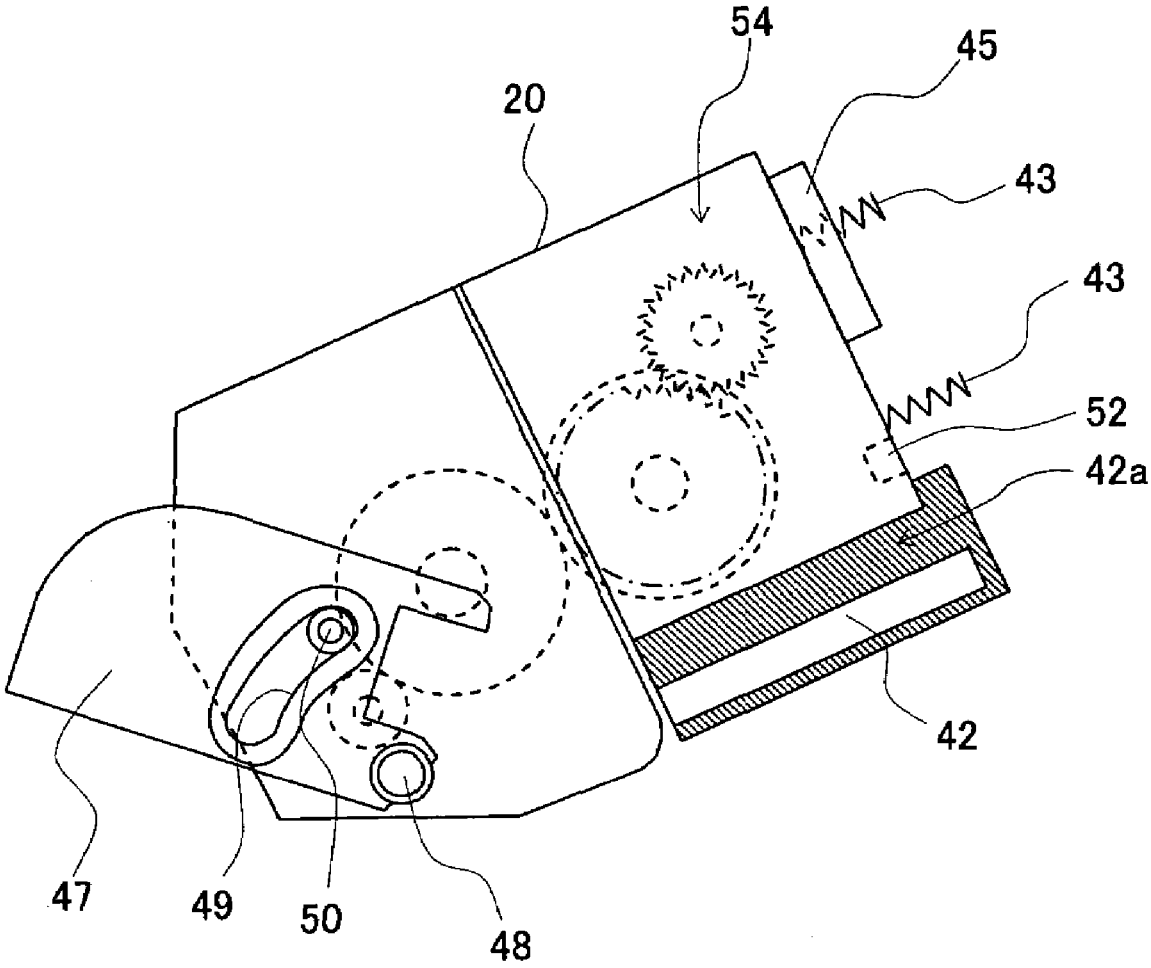
FIG. 5 is a partial view showing essential parts of the fixing device.

A guiding projection 41 projects from a guide wall 40 rising from the side edge of the slope 37 in parallel to the slope 37. As shown in FIG. 5, the projection 41 projecting from the guide wall 40 is fitted into a recess 42*a* formed at each of the upper edges of other projections (i.e., slide portions according to the present invention) 42 projecting from the lower portions on both side walls of the fixing unit 20, so that the projection 42 of the fixing unit 20 can smoothly slide and be guided on the slope 37. Here, the projection 42 may be formed at the intermediate portion of the fixing unit 20.

Figure 6:
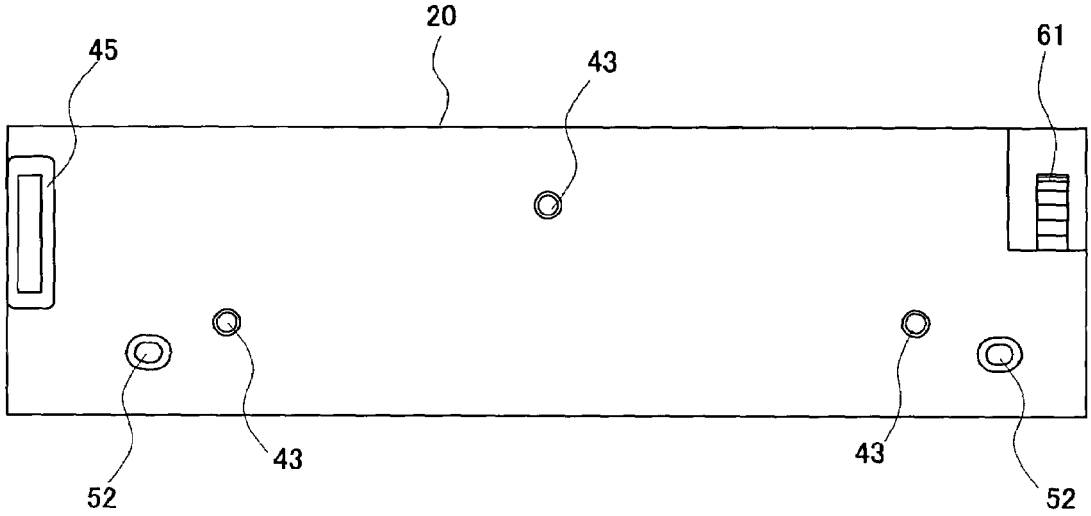
FIG. 6 is a front view of the fixing device showing the fixing device as viewed from the side of the installation.

As shown in FIGS. 5 and 6, three conductive coil springs (i.e., resilient members) 43, 43 and 43 for grounding the fixing unit 20 on the side of the apparatus body are disposed at the tip on the insertion side of the fixing unit 20. Incidentally, the coil spring 43 may be disposed at a frame member 58 on the side of the apparatus body. Otherwise, a disk spring may be used in place of the coil spring 43.

A connector 45 to be connected to a connector 44 on the receiving side disposed in the frame member 58 on the side of the apparatus body is disposed at the tip on the insertion side of the fixing unit 20, so as to receive electric power or various kinds of control signals from the apparatus body. When the fixing unit 20 is disposed on the side of the apparatus body, the electric connection via the connectors 44 and 45 enables the electric power to be supplied from a power source to the heater lamps h1 and h2 serving as the heating means or a detection signal to be transmitted from the temperature detector in the fixing unit 20 to the control unit in the apparatus body. Incidentally, as shown in FIG. 6, although the connectors 44 and 45 are disposed on the side opposite to a drive gear 61 in the fixing unit 20, they may be disposed together on either side if there is a sufficient space.

Figure 2:
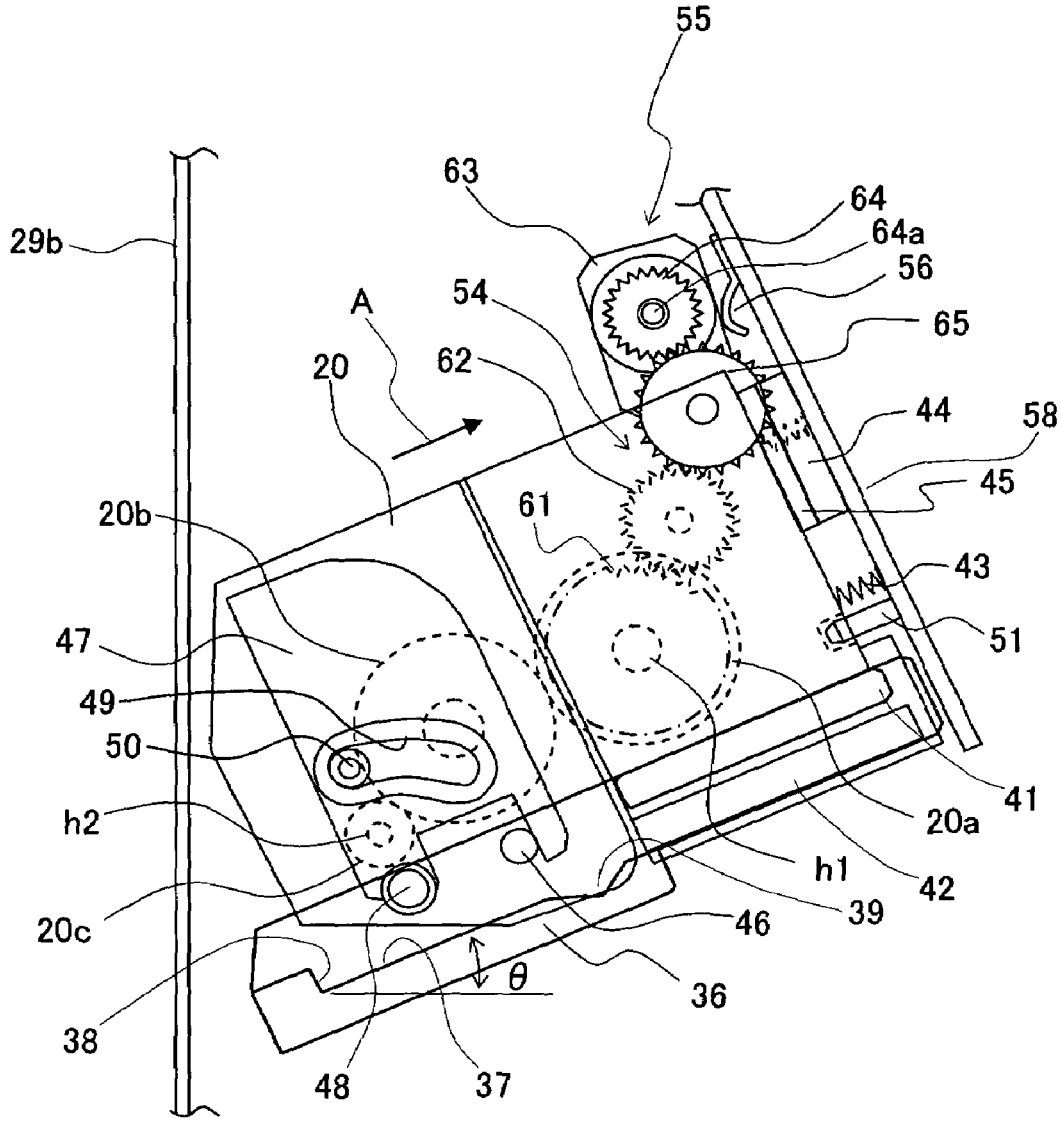
FIG. 2 is a partial view showing a state in which a fixing device for use in the image forming apparatus is installed in the main body of the image forming apparatus.

As shown in FIG. 2, a lock shaft 46 for locking the fixing unit 20 in the state disposed in the apparatus body projects from substantially the intermediate position of the guide rail 36, and further, a lock lever 47 engageably latched with the lock shaft 46 is turnably pivoted on a strut 48 projecting from the lower rear portion of the fixing unit 20. Moreover, an inductor 50 projecting from the side of the fixing unit 20 is loosely fitted into an arcuate guide hole 49 formed at the lock lever 47.

The lock lever 47 engaged with the lock shaft 46 is adapted to fix the fixing unit 20 to the apparatus body. It is desirable that the lever 47 should be made of a slidable material having mechanical strength, which is not subject to damage from sliding with the lock shaft 46, such as polycarbonate, so as to suppress the propagation of the heat from the fixing unit 20 provided with the heat generators. Additionally, the lock shaft 46 should be preferably made of a rod material, for example, iron-based metal such as stainless steel.

Figure 7:
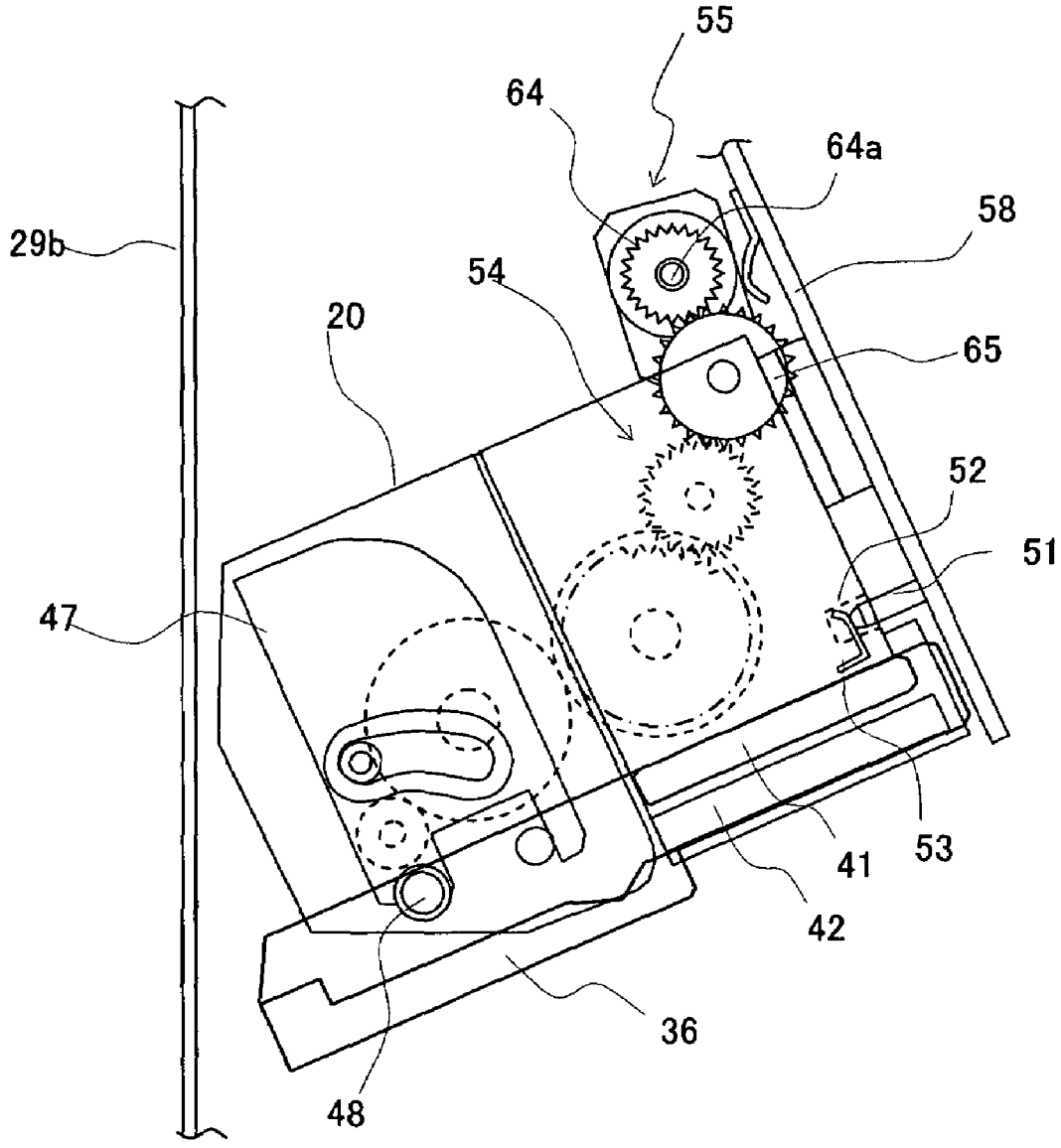
FIG. 7 is another partial view showing a state in which the fixing device is installed in the main body of the image forming apparatus.

In the meantime, a positioning boss 51 projects from the frame member 58 inside of the apparatus body. When the fixing unit 20 is pushed into the apparatus body, the positioning boss 51 is fitted into a positioning recess 52 formed on the insertion side of the fixing unit 20. Consequently, the fixing unit 20 can be positioned on the side of the apparatus body. As shown in FIG. 7, a grounding disk spring 53, which is brought into press-contact with the tip of the positioning boss 51 in a pressed state, is disposed inside of the positioning recess 52 of the fixing unit 20, thereby achieving the energizing state between the fixing unit 20 and the apparatus body. Incidentally, the pair of positioning bosses 51 are disposed in the lengthwise direction in the image forming apparatus, thereby achieving the lengthwise positioning with good balance.

In the frame member 58 inside of the apparatus body, there is provided a rotation output unit 55 for applying rotation drive force from the apparatus body to a rotation input unit 54 for transmitting the rotation drive force to the roller members 20*a* and 20*b* in the fixing unit 20. The rotation output unit 55 is disposed such that it can be brought into or out of contact with the rotation input unit 54 in the fixing unit 20 in a tilting or shifting manner. Furthermore, the shifting direction of the rotation output unit 55 is set to coincide with the sliding direction of the fixing unit 20. Moreover, a pressing spring (i.e., a pressing member) 56 is provided in the frame member 58 such that the rotation output unit 55 is brought into firm contact with the rotation input unit 54 in the fixing unit 20. The shifting direction of the rotation output unit 55 is set to substantially the same as the moving direction of the fixing unit 20 on the slope 37 by its own weight.

The above-described rotation input unit 54 in the fixing unit 20 includes a drive gear 62 which meshes with the gear 61 fixed to the fixing roller 20*a*. The drive gear 62 is turnably pivoted at a predetermined position of the fixing unit 20. In contrast, the rotation output unit 55 shiftingly disposed on the side of the apparatus body is constituted of a pair of connecting gears 64 and 65 turnably pivoted on a connecting plate 63, which is pressed by the pressing spring (i.e., the pressing member) 56. Consequently, the connecting gear 65 is pressed in the direction in which it can mesh with the gear 61.

Additionally, the above-described connecting gear 64 is connected to a motor (not shown) serving as a drive source. A drive shaft 64*a* of the connecting gear 64 is connected to the knob 27 positioned on the fore side of the image forming apparatus. The roller members 20*a* and 20*b* of the fixing unit 20 can be turned by turning the knob 27.

The electrostatic force is liable to build in the fixing unit 20 since the image transferred onto the sheet member by utilizing the electrostatic force is fixed. The electrostatic force causes the developer on the sheet member to be offset on the fixing roller 20*a*, thereby inducing the degradation of the quality of the image, or the remaining electrostatic force is electrically discharged, thereby raising a problem of the disorder of the image on the sheet member. In view of these problems, the fixing unit 20 need be grounded with respect to the apparatus body.

Therefore, in particular, in the present preferred embodiment, the fixing unit 20 is securely grounded to the apparatus body by the grounding disk spring (which is formed of a stainless steel wire for a spring, a phosphor bronze plate for a spring or the like) 53 in press contact with the positioning boss 51 fixed to the frame member 58 of the apparatus body and the three coil springs (each of which is formed of a stainless steel wire for a spring, a piano wire or the like) 43, 43 and 43 disposed at the tip of the fixing unit 20, as described above. Incidentally, although their resiliencies (i.e., repulsive force) are equal to each other since the three coil springs 43 are made of the same part, the resiliency may be made slightly stronger on the side of the connectors 44 and 45, so as to effectively aid in detaching the connectors 44 and 45.

The fixing unit 20 is pressed from the apparatus body in a direction indicated by an open arrow in FIG. 3 by the resiliencies of the grounding disk spring 53, the coil springs 43 and the pressing spring 56, so that movement of the fixing unit 20 can be initiated even if the angle of the slope 37 at the guide rail 36 is small. As shown in FIG. 3, the lock lever 47 is turned in an unlocking direction, the fixing unit 20 can be allowed to slide down to the terminal position by utilizing its own weight without any touch to the fixing unit 20. At this time, the connector 45 is automatically disconnected from the connector 44 on the receiving side. When the fixing unit 20 reaches the terminal position, it can be speedily cooled by effective heat irradiation owing to the outside air.

The turning operation for releasing the lock lever 47 from the lock shaft 46 can also be easily performed by the effect of the resiliencies of the above-described resilient members 53, 43 and 56 without requiring any large force. Furthermore, the angle of the slope 37 can be reduced due to the resiliencies of the grounding disk spring 53, the coil spring 43 and the pressing spring 56, thus making the apparatus compact.

In the case where the fixing unit 20 re-attached again after the fixing unit 20 has been detached from the guide rail 36, the fixing unit 20 is once placed on the guide rail 36 in substantially the horizontal state, and then, the lower portion at the tip thereof is fitted to the recess 39, as shown in FIG. 4. As shown in FIG. 3, the fixing unit 20 is placed again along the guide rail 36, to be pushed slantwise upward, and then, the lock lever 47 is latched to the lock shaft 46.

As is clear from the above description, the present preferred embodiment can produce the following effects.

Since the guide member is provided with the slope inclined upward in the insertion direction, the fixing device is caused to slide by utilizing the slope when the fixing device is detached from the apparatus body, so that the fixing device can be exposed to the outside with high workability. Consequently, the heat can be effectively irradiated. In contrast, when the fixing unit is attached to the main body of the image forming apparatus, the fixing device is pushed by utilizing the slope. Thus, the fixing device can be attached or detached with high workability.

Since the fixing device is guided by the guide member in the direction perpendicular to the transportation path when the fixing device is attached to or detached from the main body of the image forming apparatus, the fixing device can be separated from the transportation path even without retracting the transportation members such as the transportation roller disposed in the vicinity of the fixing device.

Since the inclination angle of the slope at the guide means is set to such an angle that the fixing device can slide down by its own weight, the fixing device can be withdrawn without firmly grasping by a hand.

The stopper is disposed at the terminal of the slope, so that the fixing device can be caused to fall down by its own weight, and then, it can be held at the position exposed to the outside. Even if the temperature of the fixing device is high, the fixing device as a whole is exposed to the outside such that the heat is irradiated before the fixing device is further withdrawn.

Since the recess is formed at the slope, the sliding portion disposed in the fixing device is fitted into the recess in the case where the fixing device is inserted into or detached from the guide member, and therefore, the fixing device can be temporarily held in the horizontal manner. As a consequence, the fixing device can be easily attached to or detached from the guide member.

The conductive resilient members are disposed at the tip on the insertion side of the fixing device, so that the fixing device can be readily grounded with respect to the main body of the image forming apparatus. Moreover, the resiliency of the resilient member functions as the force in the direction in which the fixing device is detached from the apparatus body, thereby serving in detaching the connector or reducing the initial resistance when the fixing device is allowed to slide. Thus, the inclination angle of the slope need not be increased, thereby making the apparatus compact.

The shiftable rotation output unit is disposed in the apparatus body. The pressing member for pressing the rotation output unit against the fixing unit is provided in the main body of the image forming apparatus, so that the pressing force of the pressing member acts as force for pressing the fixing device to the outside of the main body of the image forming apparatus, thereby serving in detaching the connector or reducing the initial resistance when the fixing device is allowed to slide. Thus, the inclination angle of the slope need not be increased, thereby making the apparatus compact.

It is to be understood that the present invention is not restricted to the particular preferred embodiment given above, and that various modifications and alterations can be added thereto without departing from the scope of the present invention.

What is claimed is:

1. An image forming apparatus comprising:

a fixing device disposed on a transportation path, on which a sheet member having a non-fixed image formed thereon is transported, and having roller members for fixing the image by the application of heat to the non-fixed image;

a mounting device for freely attaching or detaching the fixing device to or from the image forming apparatus; and the mounting device including a guide member associated with the image forming apparatus for guiding the fixing device in a slidable manner;

the guide member including an inclined surface on which the fixing device is placed to be guided upwards along the inclined surface when the fixing device is attached to the image forming apparatus by the mounting device.

2. An image forming apparatus according to claim 1, wherein the image is formed on the sheet member on the transportation path, and the guide member guides the fixing device in a direction substantially perpendicular to the transportation path.

3. An image forming apparatus according to claim 1, wherein the inclination angle of the guide member causes the fixing device to slide by its own weight when the fixing device is withdrawn out of the image forming apparatus.

4. An image forming apparatus according to claim 3, wherein said guide member includes a stopper for stopping motion of the fixing device as the fixing device slides out of the image forming device.

5. An image forming apparatus according to claim 1, wherein the guide member includes a stopper for holding the fixing device when the fixing device is moved to a lower end of the inclined surface.

6. An image forming apparatus according to claim 5, wherein the fixing device includes a sliding portion which is brought into sliding contact with the inclined surface;

the inclined surface has a recess for holding the sliding portion of the fixing device in temporary engagement; and the recess is formed on the inclined surface closer toward the inside of the image forming apparatus than the stopper.

7. An image forming apparatus according to claim 1, further comprising a conductive resilient member for grounding the fixing device to the image forming apparatus.

8. An image forming apparatus according to claim 7, wherein said conductive resilient member provides a force for causing said fixing device to move along said inclined surface.

9. An image forming apparatus according to claim 1, further comprising:

a rotation input unit for transmitting rotating drive force to the roller members in the fixing device;

a rotation output unit provided in the image forming apparatus in such a manner as to be freely brought into contact with or separated from the rotation input unit for applying the rotating drive force to the rotation input unit when in contact with the rotation input unit; and a pressing member for pressing the rotation output unit against the fixing device;

wherein the rotation output unit is shiftable in a direction corresponding to the direction in which the fixing device is moved on the inclined surface such that the rotation output unit is connected to the rotation input unit in a secure contact therewith by pressing the rotation output unit against the fixing device by the pressing member.

10. An image forming apparatus comprising:

an image fixing device for fixing an image formed by said apparatus;

a mounting device for mounting said fixing device to the apparatus and allowing said fixing device to be removed from the apparatus;

the mounting device including an inclined surface and a support member for supporting the fixing device on the inclined surface, wherein the fixing device is slidable along said inclined surface in an upward direction for attachment to the image forming apparatus and slidable along said inclined surface in a downward direction for detachment from said image forming apparatus.

11. An image forming apparatus according to claim 10, wherein the inclination angle of the inclined surface causes the fixing device to slide by its own weight when the fixing device is withdrawn out of the image forming apparatus.

12. An image forming apparatus according to claim 11, wherein said mounting device includes a stopper for stopping motion of the fixing device as the fixing device slides out of the image forming apparatus.

* * * * *